US007048609B2

(12) United States Patent
Togawa

(10) Patent No.: US 7,048,609 B2
(45) Date of Patent: May 23, 2006

(54) PRESSURE CONTROL SYSTEM AND POLISHING APPARATUS

(75) Inventor: Tetsuji Togawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/169,796

(22) Filed: Jun. 30, 2005

(65) Prior Publication Data

US 2005/0239371 A1 Oct. 27, 2005

Related U.S. Application Data

(63) Continuation of application No. 10/935,302, filed on Sep. 8, 2004, now Pat. No. 6,926,585.

(30) Foreign Application Priority Data

Sep. 9, 2003 (JP) ..... 2003-317552

(51) Int. Cl.
*B24B 49/00* (2006.01)

(52) U.S. Cl. ..... 451/5; 451/6; 451/296; 451/288

(58) Field of Classification Search ..... 451/5, 451/6, 8–10, 41, 56, 59, 285–290, 296, 526–529, 451/538, 539; 156/345.12, 345.13; 438/5, 438/8, 592, 959; 700/121, 164
See application file for complete search history.

(56) References Cited

U.S. PATENT DOCUMENTS 5,762,539 A * 6/1998 Nakashiba et al. ..... 451/41
6,129,613 A * 10/2000 Bothra ..... 451/66
6,241,578 B1 * 6/2001 Togawa et al. ..... 451/5
6,275,290 B1 * 8/2001 Cerni et al. ..... 356/335
6,594,542 B1 * 7/2003 Williams ..... 700/164
6,857,947 B1 * 2/2005 Wang et al. ..... 451/296

FOREIGN PATENT DOCUMENTS

WO 2004/105112 12/2004

* cited by examiner

*Primary Examiner*—Lee D. Wilson
*Assistant Examiner*—Anthony Ojini
(74) *Attorney, Agent, or Firm*—Wenderoth, Lind & Ponack, L.L.P.

(57) ABSTRACT

A pressure control system is used for eliminating individual differences of a plurality of pressure controllers used for controlling pressures of a plurality of pressure-controlled sections. The pressure control system includes a plurality of pressure controllers for supplying a pressurized fluid to a plurality of pressure-controlled sections, a master pressure controller for supplying a pressurized fluid having a reference pressure, a plurality of calibration chambers corresponding to the pressure controllers. The pressure control system further includes differential-pressure detecting devices provided in the calibration chambers to detect a differential pressure between the pressurized fluid supplied from the master pressure controller and the pressurized fluid supplied from the pressure controller, and an arithmetic device configured to receive a signal from the differential-pressure detecting device and adjust an output of the pressure controller so that the above differential pressure becomes zero or approximately zero.

15 Claims, 7 Drawing Sheets

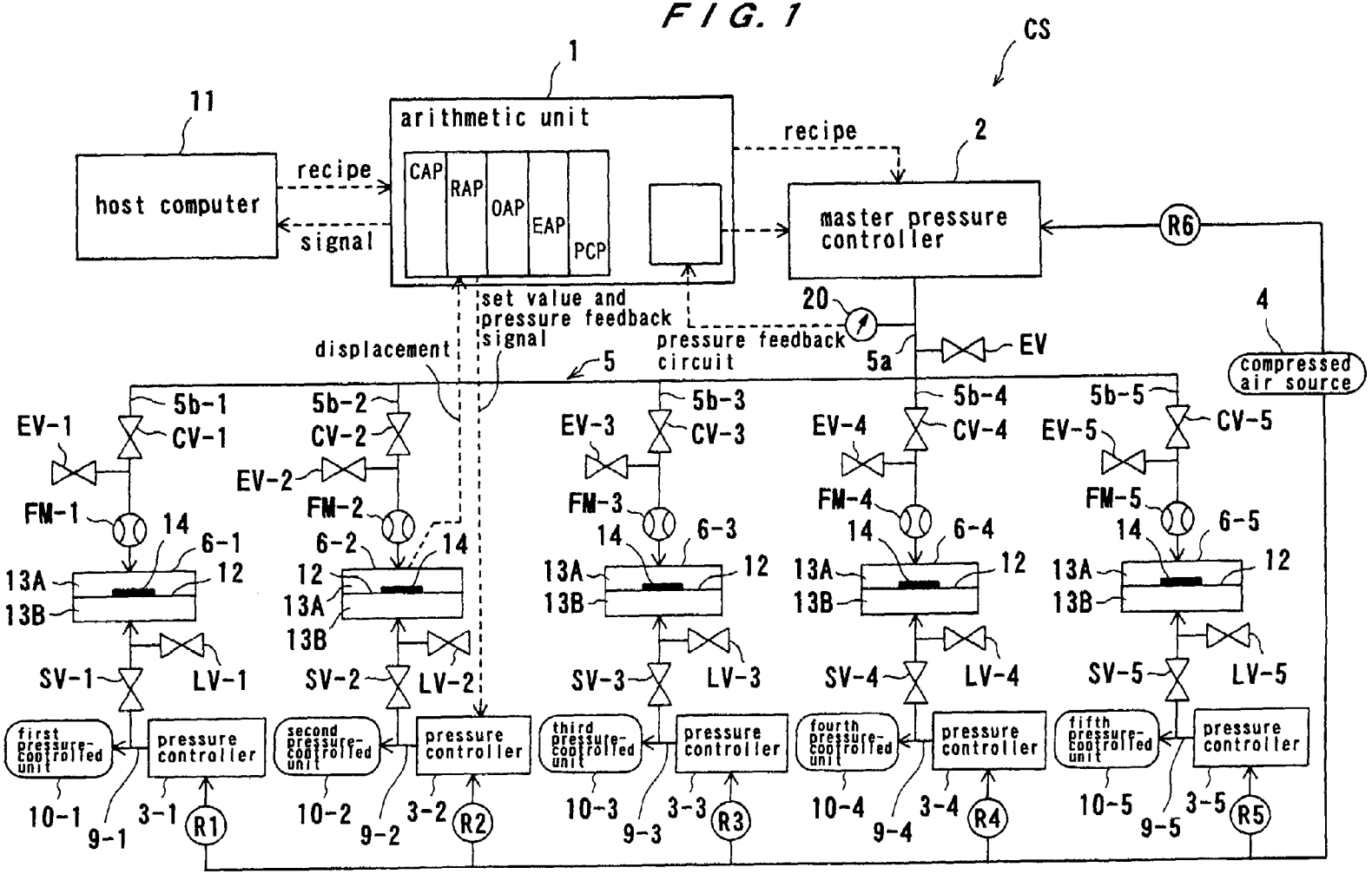
FIG. 1
CS
1
arithmetic unit
CAP
RAP
OAP
EAP
PCP
recipe
signal
11
host computer
2
master pressure controller
recipe
R6
4
compressed air source
EV
20
pressure feedback circuit
5a
5
set value and pressure feedback signal
displacement
5b-1
5b-2
5b-3
5b-4
5b-5
CV-1
CV-2
CV-3
CV-4
CV-5
EV-1
EV-2
EV-3
EV-4
EV-5
FM-1
FM-2
FM-3
FM-4
FM-5
6-1
6-2
6-3
6-4
6-5
12
13A
13B
14
LV-1
LV-2
LV-3
LV-4
LV-5
SV-1
SV-2
SV-3
SV-4
SV-5
pressure controller
3-1
3-2
3-3
3-4
3-5
R1
R2
R3
R4
R5
9-1
9-2
9-3
9-4
9-5
first pressure-controlled unit
second pressure-controlled unit
third pressure-controlled unit
fourth pressure-controlled unit
fifth pressure-controlled unit
10-1
10-2
10-3
10-4
10-5

PRESSURE CONTROL SYSTEM AND POLISHING APPARATUS

This is a Continuation Application of U.S. patent application Ser. No. 10/935,302, filed Sep. 8, 2004 now U.S. Pat. No. 6,926,585.

BACKGROUND OF THE INVENTION

1. Field of the Invention

The present invention relates to a pressure control system which can eliminate individual differences of a plurality of pressure controllers used for controlling pressures of a plurality of pressure-controlled sections (or units). The present invention also relates to a substrate holding apparatus for holding a substrate such as a semiconductor wafer to be polished and pressing the substrate against a polishing surface and a polishing apparatus having such a substrate holding apparatus.

2. Description of the Related Art

In recent years, semiconductor devices have become smaller in size and structures of semiconductor elements have become more complicated. In addition, the number of layers in multilayer interconnects used for a logical system has been increased. Accordingly, irregularities on a surface of a semiconductor device become increased, and hence step heights on the surface of the semiconductor device tend to be larger. This is because, in a manufacturing process of a semiconductor device, a thin film is formed on a semiconductor device, then micromachining processes, such as patterning or forming holes, are performed on the semiconductor device, and these processes are repeated many times to form subsequent thin films on the semiconductor device.

When the number of irregularities on a surface of a semiconductor device is increased, a thickness of a thin film formed on a portion having a step tends to be small. Further, an open circuit is caused by disconnection of interconnects, or a short circuit is caused by insufficient insulation between interconnect layers. As a result, good products cannot be obtained, and the yield tends to be reduced. Furthermore, even if a semiconductor device initially works normally, reliability of the semiconductor device is lowered after a long-term use. At the time of exposure in a lithography process, if a surface to be irradiated has irregularities, then a lens unit in an exposure system cannot focus on such irregularities. Therefore, if the irregularities of the surface of the semiconductor device are increased, then it becomes difficult to form a fine pattern on the semiconductor device.

Accordingly, in a manufacturing process of a semiconductor device, it becomes increasingly important to planarize a surface of a semiconductor device. The most important one of the planarizing technologies is CMP (Chemical Mechanical Polishing). The chemical mechanical polishing is performed with use of a polishing apparatus. Specifically, a substrate such as a semiconductor wafer is brought into sliding contact with a polishing surface such as a polishing pad while a polishing liquid containing abrasive particles such as silica ($SiO_2$) is supplied onto the polishing surface, so that the substrate is polished.

This type of polishing apparatus comprises a polishing table having a polishing surface constituted by a polishing pad, and a substrate holding apparatus, called a top ring or a carrier head, for holding a semiconductor wafer. A semiconductor wafer is polished by the polishing apparatus as follows: The semiconductor wafer is held by the substrate holding apparatus and then pressed against the polishing table under a predetermined pressure. At this time, the polishing table and the substrate holding apparatus are moved relative to each other for thereby bringing the semiconductor wafer into sliding contact with the polishing surface. Accordingly, the surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may insufficiently be polished or may excessively be polished at some portions depending on the pressing force applied to those portions of the semiconductor wafer. In order to avoid such a drawback, it has been attempted to form a surface, for holding a semiconductor wafer, of a substrate holding apparatus with use of an elastic membrane made of an elastic material such as rubber and apply a fluid pressure such as an air pressure to a backside surface of the elastic membrane so as to uniform a pressing force applied to the semiconductor wafer over an entire surface of the semiconductor wafer.

The polishing pad is so elastic that the pressing force applied to a peripheral portion of the semiconductor wafer tends to become non-uniform. Accordingly, only the peripheral portion of the semiconductor wafer may excessively be polished, which is referred to as "edge rounding". In order to prevent such edge rounding, there has been used a substrate holding apparatus in which a semiconductor wafer is held at its peripheral portion by a guide ring or a retainer ring, and the annular portion of the polishing surface that corresponds to the peripheral portion of the semiconductor wafer is pressed by the guide ring or retainer ring.

The thickness of a thin film formed on a surface of a semiconductor wafer varies from position to position in a radial direction of the semiconductor wafer depending on a film deposition method or characteristics of a film deposition apparatus. Specifically, the thin film has a film thickness distribution in the radial direction of the semiconductor wafer. Since a conventional substrate holding apparatus, as described above, for uniformly pressing an entire surface of a semiconductor wafer polishes the semiconductor wafer uniformly over the entire surface thereof, it cannot realize a polishing a mount distribution that is equal to the aforementioned film thickness distribution on the surface of the semiconductor wafer.

There has been proposed a polishing apparatus for applying locally different pressures to a semiconductor wafer to make the pressing force for pressing a thicker film region on the semiconductor wafer against a polishing surface greater than the pressing force for pressing a thinner film region on the semiconductor wafer against the polishing surface, thereby selectively increasing the polishing rate of the thicker film region. Thus, the overall surface of the substrate can be polished in proper quantities irrespective of the film thickness distribution that has been provided when the film is grown on the semiconductor wafer.

However, when the respective pressures of a fluid such as pressurized air supplied to respective pressure chambers positioned on the reverse side of the semiconductor wafer are independently controlled so that the pressure applied to the semiconductor wafer for every zone (region) is controlled, it is necessary that a plurality of pressure controllers which are the same in number as the pressure chambers are installed with a one-to-one correspondence and the pressures of the respective pressure chambers are controlled at desired values by the respective pressure controllers. In this case, each of the pressure controllers can perform feedback control for itself, but cannot perform any control between itself and other pressure controllers. Specifically, each of the pressure controllers cannot eliminate an individual difference between itself and other pressure controllers. Therefore, even if the fluid having the same pressure is expected to be supplied to the respective pressure chambers by controlling the respective pressure controllers, the respective pressure chambers cannot be kept at the same pressure because pressures outputted from the respective pressure controllers are different from each other by the individual differences of the pressure controllers. Accordingly, the semiconductor wafer cannot be polished uniformly over the entire surface thereof.

Further, even if a predetermined differential pressure is expected to be developed between the two pressure chambers to make a pressing force for pressing a thicker film region on a semiconductor wafer against a polishing surface greater than a pressing force for pressing a thinner film region on the semiconductor wafer against the polishing surface, thereby selectively increasing the polishing rate of the thicker film region, the predetermined differential pressure cannot be developed between the two pressure chambers because pressures outputted from the two pressure controllers are added by pressure errors caused by the individual differences of the pressure controllers. As a result, the respective zones (regions) of the semiconductor wafer cannot be polished at desired polishing rates.

In the above example, the individual differences of the pressure controllers are described in the case where the pressure controllers are incorporated in the polishing apparatus. However, in the case where pressures of a plurality of pressure-controlled sections (or units) are controlled using a plurality of pressure controllers, the same problem arises due to the individual differences of the pressure controllers. Specifically, pressures of the respective pressure-controlled sections cannot be controlled to desired values owing to the individual differences of the respective pressure controllers.

SUMMARY OF THE INVENTION

The present invention has been made in view of the above conventional problems. It is therefore an object of the present invention to provide a pressure control system which can eliminate individual differences of a plurality of pressure controllers used for controlling pressures of a plurality of pressure-controlled sections (or units).

Another object of the present invention is to provide a substrate holding apparatus, for holding a substrate such as a semiconductor wafer and pressing the substrate against a polishing surface, which can accurately control pressures of a fluid such as pressurized air supplied to respective pressure chambers positioned on a reverse side of the substrate to desired values, and a polishing apparatus having such a substrate holding apparatus.

In order to achieve the above object, according to a first aspect of the present invention, there is provided a pressure control system comprising: a plurality of pressure controllers configured to supply a pressurized fluid to a plurality of pressure-controlled sections; a master pressure controller configured to supply a pressurized fluid having a reference pressure; a plurality of calibration chambers corresponding to the pressure controllers, the pressurized fluid being supplied from the master pressure controller to the calibration chambers and the pressurized fluid being supplied from the pressure controllers to the calibration chambers, respectively; differential-pressure detecting devices provided in the calibration chambers, each of the differential-pressure detecting devices being configured to detect a differential pressure between the pressurized fluid supplied from the master pressure controller and the pressurized fluid supplied from the pressure controller; and an arithmetic device configured to receive a signal from the differential-pressure detecting device and adjust an output of the pressure controller so that the differential pressure between the pressurized fluid supplied from the master pressure controller and the pressurized fluid supplied from the pressure controller becomes zero or approximately zero.

According to the pressure control system of the present invention, a pressurized fluid having a predetermined pressure as a reference pressure (criterion) is supplied from the master pressure controller to the calibration chamber, and a pressurized fluid is supplied from the pressure controller to the calibration chamber, and then a differential pressure between the pressurized fluid supplied from the master pressure controller and the pressurized fluid supplied from the pressure controller is detected in the differential-pressure detecting device in the calibration chamber. Then, the differential pressure detected by the differential-pressure detecting device is inputted into the arithmetic device, and the output of the pressure controller is adjusted by the arithmetic device so that the above differential pressure becomes zero or approximately zero. Therefore, the pressures of the plural pressure controllers can be calibrated on the basis of the output of the master pressure controller as a reference pressure (criterion).

According to the pressure control system of the present invention, the pressures of the plural pressure controllers can be calibrated on the basis of the output of the master pressure controller as a reference pressure (criterion), and hence the plural pressure controllers can eliminate individual differences. Thus, the pressures of the plural pressure controllers can be accurately controlled to desired respective values.

In a preferred aspect of the present invention, the differential-pressure detecting device comprises a diaphragm provided in the calibration chamber and configured to separate the pressurized fluid supplied from the master pressure controller and the pressurized fluid supplied from the pressure controller from each other, and a sensor configured to detect displacement of the diaphragm.

In a preferred aspect of the present invention, a pressure control system further comprises a closing valve provided between the master pressure controller and each of the calibration chambers and configured to seal the pressurized fluid supplied from the master pressure controller in the calibration chamber hermetically by closing the closing valve.

In a preferred aspect of the present invention, a pressure control system further comprises a leakage sensor configured to detect a leakage of the pressurized fluid from the calibration chamber while the closing valve is closed.

According to a second aspect of the present invention, there is provided a substrate holding apparatus for holding a substrate and pressing the substrate against a polishing surface, comprising: a pressure control system comprising: a plurality of pressure controllers configured to supply a pressurized fluid to a plurality of pressure-controlled sections; a master pressure controller configured to supply a pressurized fluid having a reference pressure; a plurality of calibration chambers corresponding to the pressure controllers, the pressurized fluid being supplied from the master pressure controller to the calibration chambers and the pressurized fluid being supplied from the pressure controllers to the calibration chambers, respectively; differential-pressure detecting devices provided in the calibration chambers, each of the differential-pressure detecting devices being configured to detect a differential pressure between the pressurized fluid supplied from the master pressure controller and the pressurized fluid supplied from the pressure controller; and an arithmetic device configured to receive a signal from the differential-pressure detecting device and adjust an output of the pressure controller so that the differential pressure between the pressurized fluid supplied from the master pressure controller and the pressurized fluid supplied from the pressure controller becomes zero or approximately zero; a top ring body for holding the substrate; a plurality of pressure chambers formed in the top ring body; and a plurality of fluid passages configured to connect the pressure chambers to the pressure controllers, respectively.

According to the substrate holding apparatus of the present invention, since the pressures of the plural pressure controllers can be calibrated on the basis of the output of the master pressure controller as a reference pressure (criterion), the pressures of the pressurized fluid supplied to the respective pressure chambers positioned on the reverse side of the substrate can be controlled to desired values.

According to the substrate holding apparatus of the present invention, the pressures of the pressurized fluid supplied to the respective pressure chambers positioned on the reverse side of the substrate such as a semiconductor wafer to be polished can be accurately controlled to desired values, the pressure applied to the substrate can be accurately controlled for every zone (region).

In a preferred aspect of the present invention, a substrate holding apparatus further comprises a plurality of sensors disposed in the fluid passages, respectively, and configured to detect flowing states of the fluid which flow through the fluid passages.

In a preferred aspect of the present invention, the sensors are disposed respectively in two of the fluid passages for supplying the fluid to two adjacent ones of the pressure chambers which are divided by a boundary.

In a preferred aspect of the present invention, the differential-pressure detecting device comprises a diaphragm provided in the calibration chamber and configured to separate the pressurized fluid supplied from the master pressure controller and the pressurized fluid supplied from the pressure controller from each other, and a sensor configured to detect displacement of the diaphragm.

In a preferred aspect of the present invention, a substrate holding apparatus further comprises a closing valve provided between the master pressure controller and each of the calibration chambers and configured to seal the pressurized fluid supplied from the master pressure controller in the calibration chamber hermetically by closing the closing valve.

In a preferred aspect of the present invention, a substrate holding apparatus further comprises a leakage sensor configured to detect a leakage of the pressurized fluid from the calibration chamber while the closing valve is closed.

In a third aspect of the present invention, there is provided a polishing apparatus comprising: a polishing table having a polishing surface: and a substrate holding apparatus for holding a substrate and pressing the substrate against the polishing surface, comprising: a pressure control system comprising: a plurality of pressure controllers configured to supply a pressurized fluid to a plurality of pressure-controlled sections; a master pressure controller configured to supply a pressurized fluid having a reference pressure; a plurality of calibration chambers corresponding to the pressure controllers, the pressurized fluid being supplied from the master pressure controller to the calibration chambers and the pressurized fluid being supplied from the pressure controllers to the calibration chambers, respectively; differential-pressure detecting devices provided in the calibration chambers, each of the differential-pressure detecting devices being configured to detect a differential pressure between the pressurized fluid supplied from the master pressure controller and the pressurized fluid supplied from the pressure controller; and an arithmetic device configured to receive a signal from the differential-pressure detecting device and adjust an output of the pressure controller so that the differential pressure between the pressurized fluid supplied from the master pressure controller and the pressurized fluid supplied from the pressure controller becomes zero or approximately zero; a top ring body for holding the substrate; a plurality of pressure chambers formed in the top ring body; and a plurality of fluid passages configured to connect the pressure chambers to the pressure controllers, respectively.

According to the polishing apparatus of the present invention, since the pressures of the pressurized fluid supplied to the respective pressure chambers positioned on the reverse side of the substrate can be accurately controlled to desired values, the substrate can be pressed against the polishing surface at a desired pressure for every zone (region).

According to the polishing apparatus of the present invention, since the pressure applied to the substrate can be accurately controlled for every zone (region), the substrate can be pressed against the polishing surface at a desired pressure for every zone (region), and a polishing rate in each zone of the surface of the substrate can be made to a desired value. Therefore, by pressing the entire surface of the substrate uniformly against the polishing surface, the polishing rate can be made uniform over the entire surface of the substrate. Further, by applying different pressures to local regions of the substrate, the polishing rate of the local regions can be selectively controlled.

In a preferred aspect of the present invention, a polishing apparatus further comprises a plurality of sensors disposed in the fluid passages, respectively, and configured to detect flowing states of the fluid which flow through the fluid passages.

In a preferred aspect of the present invention, the sensors are disposed respectively in two of the fluid passages for supplying the fluid to two adjacent ones of the pressure chambers which are divided by a boundary.

In a preferred aspect of the present invention, the differential-pressure detecting device comprises a diaphragm provided in the calibration chamber and configured to separate the pressurized fluid supplied from the master pressure controller and the pressurized fluid supplied from the pressure controller from each other, and a sensor configured to detect displacement of the diaphragm.

In a preferred aspect of the present invention, a polishing apparatus further comprises a closing valve provided between the master pressure controller and each of the calibration chambers and configured to seal the pressurized fluid supplied from the master pressure controller in the calibration chamber hermetically by closing the closing valve.

In a preferred aspect of the present invention, a polishing apparatus further comprises a leakage sensor configured to detect a leakage of the pressurized fluid from the calibration chamber while the closing valve is closed.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 1 is a block diagram showing an overall arrangement of a pressure control system according to an embodiment of the present invention;

DETAILED DESCRIPTION OF THE PREFERRED EMBODIMENTS

Figure 2:
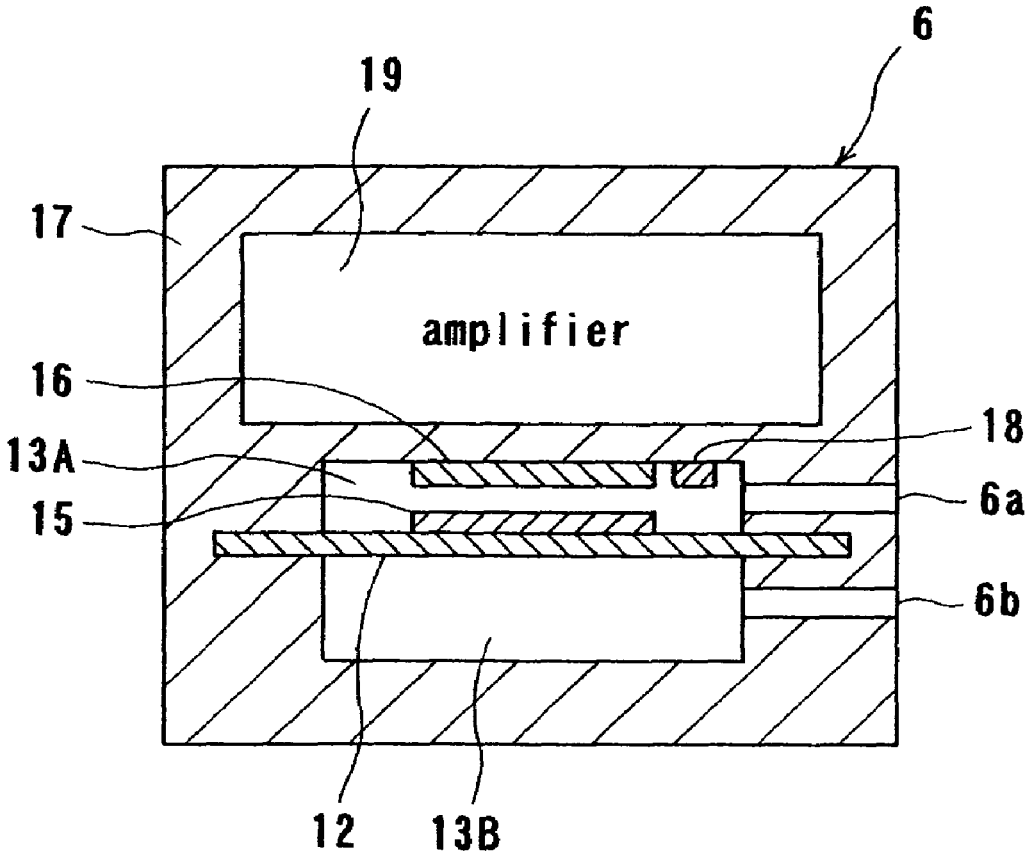
FIG. 2 is a cross-sectional view showing a calibration chamber according to an embodiment of the present invention.

A pressure control system according to an embodiment of the present invention will be described below with reference to FIGS. 1 and 2.

FIG. 1 is a block diagram showing an overall arrangement of a pressure control system according to the present invention. The pressure control system serves to control pressures of a plurality of pressure controllers accurately to desired values by calibrating pressures of the plural pressure controllers on the basis of a reference pressure (criterion) established by output of a master pressure controller. As shown in FIG. 1, a pressure control system CS according to the present invention comprises an arithmetic unit (arithmetic device) 1, a single master pressure controller 2, and a plurality of pressure controllers 3-1, 3-2, 3-3, 3-4 and 3-5. The input side of the master pressure controller 2 and the input sides of the pressure controllers 3-1, 3-2, 3-3, 3-4 and 3-5 are connected to a compressed air source 4 through regulators R1, R2, R3, R4, R5 and R6, respectively. The regulators R1, R2, R3, R4, R5 and R6 are provided to prevent sensors or the like in the pressure controllers 3-1, 3-2, 3-3, 3-4 and 3-5 from being broken due to excessively high pressure when compressed air is supplied from the compressed air source 4 to the master pressure controller 2 and the respective controllers 3-1, 3-2, 3-3, 3-4 and 3-5. For example, in the case where the output pressure range of the pressure controller is in the range of 0 to 50 kPa, the input pressure is set to 0.15 MPa±0.05 MPa. Further, in order to set pressures corresponding to a recipe, the master pressure controller 2 and the pressure controllers 3-1, 3-2, 3-3, 3-4 and 3-5 have respective pressure sensors therein, measure respective pressures at the output sides thereof, and control the pressures on the basis of the measured pressures by feedback control.

The output side of the master pressure controller 2 is connected to a plurality of calibration chambers 6-1, 6-2, 6-3, 6-4 and 6-5 through a fluid passage 5. The fluid passage 5 comprises a main fluid passage 5*a*, and branch fluid passages 5*b*-1, 5*b*-2, 5*b*-3, 5*b*-4 and 5*b*-5. A residual pressure exhaust valve EV is provided in the main fluid passage 5*a*, and closing valves CV-1, CV-2, CV-3, CV-4 and CV-5, residual pressure exhaust valves EV-1, EV-2, EV-3, EV-4 and EV-5, and flowmeters FM-1, FM-2, FM-3, FM-4 and FM-5 are provided in the respective branch fluid passages 5*b*-1, 5*b*-2, 5*b*-3, 5*b*-4 and 5*b*-5.

The output sides of the respective controllers 3-1, 3-2, 3-3, 3-4 and 3-5 are connected to a first pressure-controlled unit 10-1, a second pressure-controlled unit 10-2, a third pressure-controlled unit 10-3, a fourth pressure-controlled unit 10-4, and a fifth pressure-controlled unit 10-5, respectively, and also to calibration chambers 6-1, 6-2, 6-3, 6-4 and 6-5, respectively, through respective fluid passages 9-1, 9-2, 9-3, 9-4 and 9-5. Shutoff valves SV-1, SV-2, SV-3, SV-4 and SV-5 and relief valves LV-1, LV-2, LV-3, LV-5 and LV-5 are provided in the fluid passages 9-1, 9-2, 9-3, 9-4 and 9-5, respectively.

Next, the arithmetic unit 1 will be described in detail.

The arithmetic unit 1 has such a function for communicating with a host computer 11 that the arithmetic unit 1 receives a recipe from the host computer 11 and sends signals as pressure set values to the respective controllers 3-1, 3-2, 3-3, 3-4 and 3-5 according to the recipe. The arithmetic unit 1 can send actual output pressures to the host computer 11.

Further, the arithmetic unit 1 can control each of the controllers 3-1, 3-2, 3-3, 3-4 and 3-5 so that output of a sensor in each of the calibration chambers 6-1, 6-2, 6-3, 6-4 and 6-5 becomes zero. In the arithmetic unit 1, any control method such as a PID control method, a fuzzy control method or a neurocontrol method may be used. Further, the arithmetic unit 1 can control opening and closing of the residual pressure exhaust valves EV-1, EV-2, EV-3, EV-4 and EV-5, the closing valves CV-1, CV-2, CV-3, CV-4 and CV-5, the relief valves LV-1, LV-2, LV-3, LV-4 and LV-5, and the shutoff valves SV-1, SV-2, SV-3, SV-4 and SV-5 provided between the master pressure controller 2 and the respective controllers 3-1, 3-2, 3-3, 3-4 and 3-5. Further, the arithmetic unit 1 can control such processing as stopping of polishing operation performed by a top ring 101 (described later) as required on the basis of outputs of the flowmeters FM-1, FM-2, FM-3, FM-4 and FM-5. It is desirable to construct the arithmetic unit 1 into a module so that the number of the pressure controllers can be easily increased or decreased. Further, it is desirable to allow the arithmetic unit 1 to cope with a device net or the like.

Next, the calibration chambers 6-1, 6-2, 6-3, 6-4 and 6-5 will be described in detail.

Each of the calibration chambers 6-1, 6-2, 6-3, 6-4 and 6-5 has two pressure ports, and one of the pressure ports is connected to the master pressure controller 2 and the other of the pressure ports is connected to each of the pressure controllers 3-1, 3-2, 3-3, 3-4 and 3-5. The pressure of the master pressure controller 2 and each of the pressures of the pressure controllers 3-1, 3-2, 3-3, 3-4 and 3-5 are separated from each other by a diaphragm 12 composed of high corrosion-resistant material such as SUS316, Hestelloy, Teflon (registered trademark), or ceramics. Specifically, each of the calibration chambers 6-1, 6-2, 6-3, 6-4 and 6-5 is partitioned by the diaphragm 12 into sub-chambers 13A and 13B, and a pressurized fluid is supplied from the master pressure controller 2 to the sub-chamber 13A and a pressurized fluid is supplied from each of the pressure controllers 3-1, 3-2, 3-3, 3-4 and 3-5 to the sub-chamber 13B. A sensor 14 is attached to each of the diaphragms 12, and is located at the master pressure controller side (side of the master pressure controller 2) in consideration of generation of corrosion and dust. In the case where there is a difference between a pressure outputted from the master pressure controller 2 and a pressure outputted from one of the pressure controllers 3-1, 3-2, 3-3, 3-4 and 3-5, one of the diaphragms 12 is deformed to cause the sensor 14 attached to the diaphragm 12 to output an electrical signal to the arithmetic unit 1. Specifically, the diaphragm 12 and the sensor 14 jointly constitute a pressure-differential detection device for detecting a differential pressure between a pressurized fluid supplied from the master pressure controller and a pressurized fluid from the pressure controller. In order to convert the pressure into the electrical signal, a method in which displacement is converted into quantity of electricity by an electrostatic capacity type instrument or strain is converted into electric resistance by a strain gage may be used. Alternatively, in order to detect a force applied to the diaphragm 12, a method called a force balance type method may be utilized because the force is proportional to a pressure applied to the diaphragm and an area of the diaphragm.

FIG. 2 is a cross-sectional view showing an example of the calibration chamber. In FIG. 2, the calibration chamber is represented simply by reference numeral 6. The calibration chamber 6 has two pressure ports 6*a* and 6*b*, and the pressure port 6*a* is connected to the master pressure controller 2 and the pressure port 6*b* is connected to each of the pressure controllers 3-1, 3-2, 3-3, 3-4 and 3-5. The calibration chamber 6 is partitioned into sub-chambers 13A and 13B by a diaphragm 12 composed of high corrosion-resistant material such as SUS316, Hestelloy, ceramics, or Teflon (registered trademark), and a pressurized fluid is supplied from the master pressure controller 2 to the sub-chamber 13A and a pressurized fluid is supplied from each of the pressure controllers 3-1, 3-2, 3-3, 3-4 and 3-5 to the sub-chamber 13B. A moving electrode 15 is attached to the diaphragm 12, and a measuring electrode 16 is provided so as to face the moving electrode 15. The measuring electrode 16 is fixed to a housing 17. Further, a reference electrode 18 is provided adjacent to the measuring electrode 16. An amplifier 19 for signal amplification is disposed in the housing 17.

With the above arrangement, in the case where there is a difference between a pressure outputted from the master pressure controller 2 and a pressure outputted from each of the pressure controllers 3-1, 3-2, 3-3, 3-4 and 3-5, the diaphragm 12 is deformed to cause electrostatic capacity between the moving electrode 15 and the measuring electrode 16 to vary, but to cause electrostatic capacity between the moving electrode 15 and the reference electrode 18 to vary little. Therefore, a differential pressure can be obtained from the difference between the electrostatic capacity between the moving electrode 15 and the measuring electrode 16 and the electrostatic capacity between the moving electrode 15 and the reference electrode 18.

The pressure outputted from the master pressure controller 2 is hermetically sealed in the respective calibration chambers 6-1, 6-2, 6-3, 6-4 and 6-5 by closing the respective closing valves CV-1, CV-2, CV-3, CV-4 and CV-5, whereby the system of the present invention can be established. Therefore, it is desirable to monitor no leakage occurring at all times. Thus, according to the present invention, the flowmeters FM-1, FM-2, FM-3, FM-4 and FM-5 for leakage check are provided between the respective calibration chambers 6-1, 6-2, 6-3, 6-4 and 6-5 and the respective closing valves CV-1, CV-2, CV-3, CV-4 and CV-5 to monitor possible leakage. The flowmeters FM-1, FM-2, FM-3, FM-4 and FM-5 start the leakage check when the closing valves CV-1, CV-2, CV-3, CV-4 and CV-5 are closed by a signal indicative of the output value of the pressure sensor incorporated in the master pressure controller 2 which becomes equal to the set value of the pressure sensor, and signals indicative of closing of the closing valves CV-1, CV-2, CV-3, CV-4 and CV-5 are generated. The flowmeters FM-1, FM-2, FM-3, FM-4 and FM-5 continue monitoring of the leakage until the closing valves CV-1, CV-2, CV-3, CV-4 and CV-5 are opened. If a leakage of a fluid occurs, a predetermined signal is sent to an apparatus such as a polishing apparatus (CMP apparatus) in the pressure-controlled section, and appropriate processing is performed.

Next, the valves for controlling the system will be described in detail.

The residual pressure exhaust valves EV-1, EV-2, EV-3, EV-4 and EV-5 are provided between the closing valves CV-1, CV-2, CV-3, CV-4 and CV-5 and the calibration chambers 6-1, 6-2, 6-3, 6-4 and 6-5, respectively, and the residual pressure exhaust valve EV is provided between the closing valves CV-1, CV-2, CV-3, CV-4 and CV-5 and the master pressure controller 2. These residual pressure exhaust valves EV, EV-1, EV-2, EV-3, EV-4 and EV-5 are opened to vent pressure to atmosphere when a set pressure is changed.

On the other hand, the shutoff valves SV-1, SV-2, SV-3, SV-4 and SV-5 and the relief valves LV-1, LV-2, LV-3, LV-4 and LV-5 are provided between the pressure controllers 3-1, 3-2, 3-3, 3-4 and 3-5 and the calibration chambers 6-1, 6-2, 6-3, 6-4 and 6-5, respectively. While the calibration chambers 6-1, 6-2, 6-3, 6-4 and 6-5 are charged with pressure from the master pressure controller 2, the relief valves LV-1, LV-2, LV-3, LV-4 and LV-5 are opened. By this operation, the influence of pressure change caused by volume change when the diaphragms 12 in the calibration chambers 6-1, 6-2, 6-3, 6-4 and 6-5 are deformed can be prevented. In order to ensure fast response, the fluid passages for connecting the respective equipment are constructed by pipes having the shortest distance.

Next, operation of the pressure control system shown in FIG. 1 will be described in detail.

First, a recipe is sent from the host computer 11 to the arithmetic unit 1. At this time, the closing valves CV-1, CV-2, CV-3, CV-4 and CV-5, the residual pressure exhaust valves EV, EV-1, EV-2, EV-3, EV-4 and EV-5, the shutoff valves SV-1, SV-2, SV-3, SV-4 and SV-5, and the relief valves LV-1, LV-2, LV-3, LV-4 and LV-5 are open. The reason why all the valves are open is that extra pressure is prevented from being applied to the diaphragms 12 in the respective calibration chambers 6-1, 6-2, 6-3, 6-4 and 6-5. Then, the arithmetic unit 1 sends commands to the master pressure controller 2 and the respective pressure controllers 3-1, 3-2, 3-3, 3-4 and 3-5 according to the recipe sent from the host computer 11, and simultaneously closes the residual pressure exhaust valves EV, EV-1, EV-2, EV-3, EV-4 and EV-5 and the shutoff valves SV-1, SV-2, SV-3, SV-4 and SV-5.

Each of the pressure controllers 3-1, 3-2, 3-3, 3-4 and 3-5 starts to produce an output according to the recipe sent from the arithmetic unit 1. The arithmetic unit 1 supplies a pressure to the calibration chamber corresponding to the pressure controller having the lowest pressure in the recipe to shorten response time of the pressure, and closes the closing valve corresponding to the calibration chamber to which the pressure is supplied, after an output of a pressure sensor 20 for feedback control provided within the master pressure controller 2 or between the master pressure controller 2 and the calibration chambers becomes stable. Thus, the pressure outputted from the master pressure controller 2 is hermetically sealed in the calibration chamber. While the closing valve is closed, the flowmeter corresponding to such closing valve is operated to perform leakage check of the fluid. After the above closing valve is closed, a pressure is supplied to the calibration chamber corresponding to the pressure controller which is required to output the second lowest pressure. In this order, each of the calibration chambers is sequentially charged with a fluid having a predetermined pressure. If the same pressure is required in the plural pressure controllers, the pressure is simultaneously supplied to the calibration chambers corresponding to the plural pressure controllers.

Immediately after the closing valves are closed, the relief valves are closed and the shutoff valves are opened. Then, pressures outputted from the pressure controllers 3-1, 3-2, 3-3, 3-4 and 3-5 are supplied to the zones (the first pressure-controlled unit 10-1, the second pressure-controlled unit 10-2, the third pressure-controlled unit 10-3, the fourth pressure-controlled unit 10-4, and the fifth pressure-controlled unit 10-5) connected to the fluid passages 9-1, 9-2, 9-3, 9-4 and 9-5, and are branched at the outlets of the pressure controllers 3-1, 3-2, 3-3, 3-4 and 3-5 and supplied also to the calibration chambers 6-1, 6-2, 6-3, 6-4 and 6-5. At this time, because there is a pressure differential between the master pressure controller side and the pressure controller side which are separated from each other by the diaphragm 12, the sensor 14 attached to the diaphragm 12 detects displacement of the diaphragm 12 and outputs the detected displacement as an electrical signal. The arithmetic unit 1 which has received the electrical signal adjusts an output of each of the pressure controllers 3-1, 3-2, 3-3, 3-4 and 3-5 so that the displacement of the diaphragm 12 becomes zero. In this case, even if the sensors 14 in the calibration chambers 6-1, 6-2, 6-3, 6-4 and 6-5 have individual differences, no individual difference is generated because the displacement is zero. In the case where the same pressure is supplied to the respective pressure-controlled units 10-1, 10-2, 10-3, 10-4 and 10-5 by the respective pressure controllers 3-1, 3-2, 3-3, 3-4 and 3-5 for a long period of time, the above operations should be repeated at certain intervals.

As described above, according to the pressure control system of the present invention, exact pressure is supplied from the master pressure controller 2 to the respective calibration chambers 6-1, 6-2, 6-3, 6-4 and 6-5, and pressures of the pressure controllers 3-1, 3-2, 3-3, 3-4 and 3-5 are led to the respective calibration chambers 6-1, 6-2, 6-3, 6-4 and 6-5. If there is a pressure differential between the master pressure controller side and the pressure controller side, the diaphragm 12 in one of the calibration chambers 6-1, 6-2, 6-3, 6-4 and 6-5 is displaced, and hence the output of one of the pressure controllers 3-1, 3-2, 3-3, 3-4 and 3-5 is adjusted so that the displacement of the diaphragm 12 becomes zero. Specifically, the pressures of the plural pressure controllers 3-1, 3-2, 3-3, 3-4 and 3-5 can be calibrated on the basis of the output of the master pressure controller 2 as a reference pressure (criterion), and hence the plural pressure controllers can eliminate individual differences. Thus, the pressures of the plural pressure controllers 3-1, 3-2, 3-3, 3-4 and 3-5 can be accurately controlled to desired pressures.

Next, a substrate holding apparatus which incorporates the pressure control system CS, and a polishing apparatus according to an embodiment of the present invention will be described below with reference to FIGS. 3 through 7. The substrate holding apparatus according to the present invention has the pressure control system CS shown in FIG. 1, and can accurately control pressures of the pressurized fluid supplied to the plural pressure chambers in the substrate holding apparatus by the pressure control system CS. Specifically, the pressure-controlled sections (or units) of the pressure control system CS comprise a plurality of pressure chambers.

Figure 3:
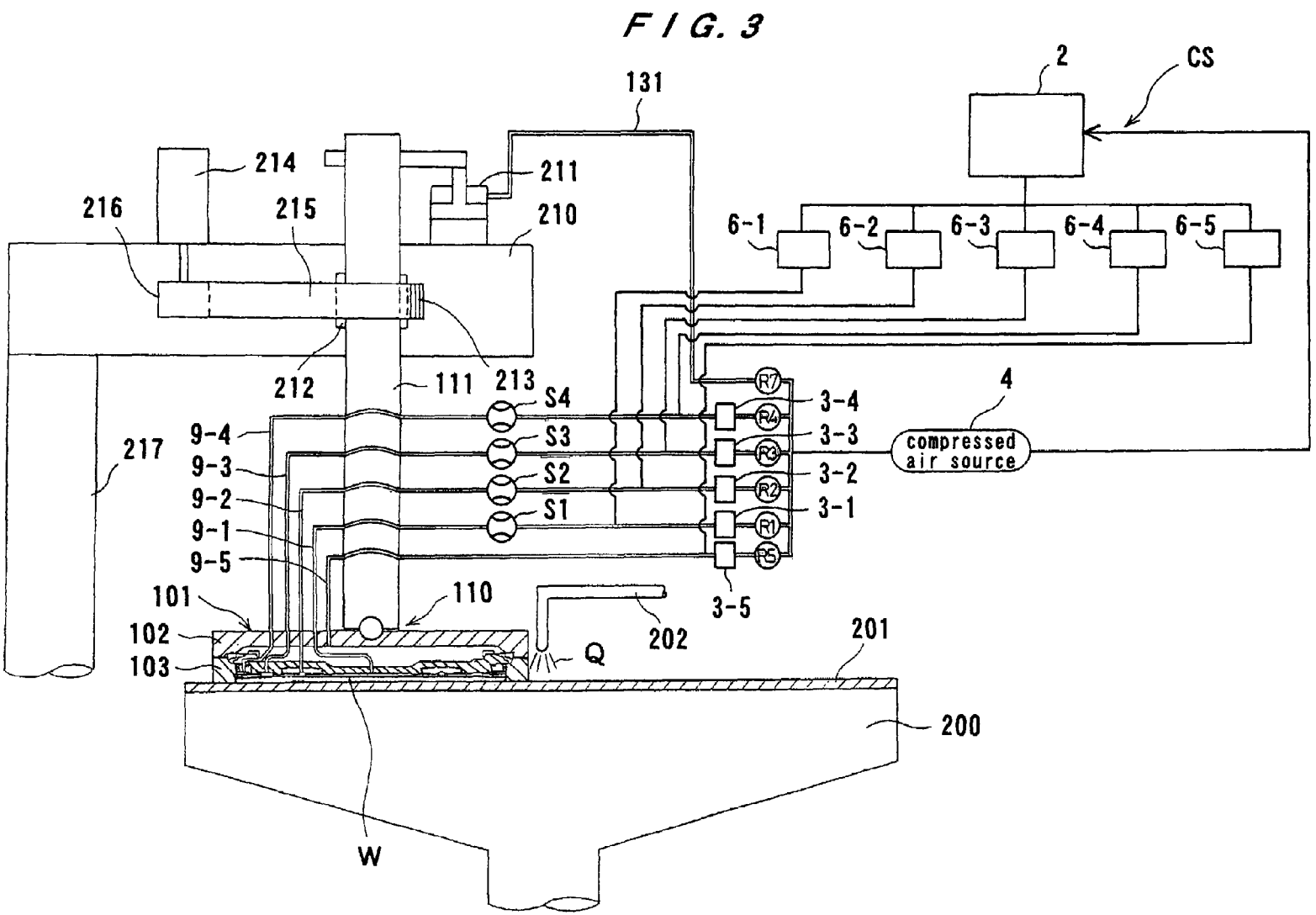
FIG. 3 is a cross-sectional view showing an overall arrangement of a polishing apparatus incorporating a substrate holding apparatus according to an embodiment of the present invention.

FIG. 3 is a cross-sectional view showing an entire arrangement of a polishing apparatus having a substrate holding apparatus according to the present invention. The substrate holding apparatus serves to hold a substrate such as a semiconductor wafer to be polished and to press the substrate against a polishing surface on a polishing table. As shown in FIG. 3, the polishing table 200 having a polishing pad 201 attached to an upper surface thereof is provided underneath a top ring 101 constituting a substrate holding apparatus according to the present invention. A polishing liquid supply nozzle 202 is provided above the polishing table 200, and a polishing liquid Q is supplied onto the polishing pad 201 on the polishing table 200 from the polishing liquid supply nozzle 202.

Various kinds of polishing pads are available on the market. For example, some of these are SUBA800, IC-1000, and IC-1000/SUBA400 (two-layer cloth) manufactured by Rodel, Inc., and Surfin xxx-5 and Surfin 000 manufactured by Fujimi Inc. SUBA800, Surfin xxx-5, and Surfin 000 are non-woven fabrics bound by urethane resin, and IC-1000 is made of rigid foam polyurethane (single-layer). Foam polyurethane is porous and has a large number of fine recesses or holes formed in its surface.

Although the polishing pad serves as the polishing surface, the present invention is not limited to the above structure. For example, the polishing surface may be constituted by a fixed abrasive. The fixed abrasive is formed into a flat plate comprising abrasive particles fixed by a binder. With the fixed abrasive for polishing, the polishing process is performed by abrasive particles that are self-generated from the fixed abrasive. The fixed abrasive comprises abrasive particles, a binder, and pores. For example, cerium dioxide ($CeO_2$) or silicon oxide ($SiO_2$) or alumina ($Al_2O_3$) having an average particle diameter of 0.5 μm or less is used as an abrasive particle, and thermosetting resin such as epoxy resin or phenol resin or thermoplastic resin such as MBS resin or ABS resin is used as a binder. Such a fixed abrasive forms a harder polishing surface. The fixed abrasive includes a fixed abrasive pad having a two-layer structure formed by a thin layer of a fixed abrasive and an elastic polishing pad attached to a lower surface of the thin layer of the fixed abrasive.

As sown in FIG. 3, the top ring 101 is connected to a top ring drive shaft 111 by a universal joint 110, and the top ring drive shaft 111 is coupled to a top ring air cylinder 211 fixed to a top ring head 210. The top ring air cylinder 211 operates to move the top ring drive shaft 111 vertically to thereby lift and lower the top ring 101 as a whole and to press a retainer ring 103 fixed to a lower end of a top ring body 102 against the polishing pad 201.

The top ring air cylinder 211 is connected to a compressed air source 4 via a fluid passage 131 and a regulator R7. The regulator R7 can regulate pressure of compressed air or the like which is supplied to the top ring air cylinder 211. Thus, it is possible to move the top ring 101 vertically and to adjust a pressing force to press the polishing pad 201 with the retainer ring 103.

The top ring drive shaft 111 is connected to a rotary sleeve 212 by a key (not shown). The rotary sleeve 212 has a timing pulley 213 fixedly disposed at a peripheral portion thereof. A top ring motor 214 is fixed to the top ring head 210, and the timing pulley 213 is coupled to a timing pulley 216 mounted on the top ring motor 214 via a timing belt 215. Therefore, when the top ring motor 214 is energized for rotation, the rotary sleeve 212 and the top ring drive shaft 111 are rotated in unison with each other via the timing pulley 216, the timing belt 215, and the timing pulley 213 to thereby rotate the top ring 101. The top ring head 210 is supported on a top ring head shaft 217 rotatably supported on a frame (not shown).

Figure 4:
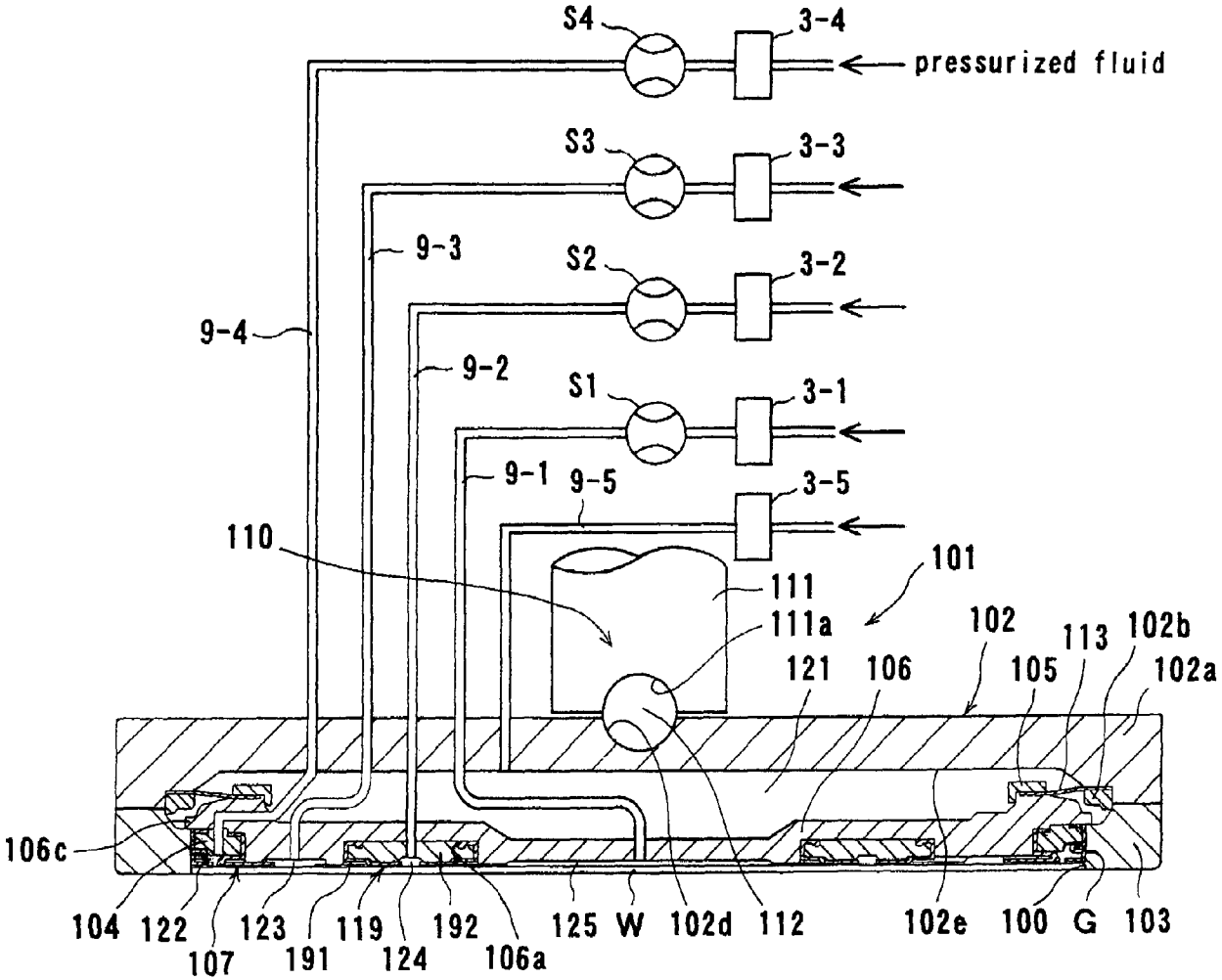
FIG. 4 is a vertical cross-sectional view of a top ring according to the embodiment of the present invention.

Next, the top ring 101 constituting a substrate holding apparatus according to the present invention will be described below in detail. FIG. 4 is a vertical cross-sectional view showing the top ring constituting the substrate holding apparatus according to the present embodiment.

As shown in FIG. 4, the top ring 101 constituting a substrate holding apparatus comprises a top ring body 102 in the form of a cylindrical housing with a receiving space defined therein, and an annular retainer ring 103 fixed to the lower end of the top ring body 102. The top ring body 102 is made of a material having high strength and rigidity, such as metal or ceramics. The retainer ring 103 is made of highly rigid synthetic resin, ceramics, or the like.

The top ring body 102 comprises a cylindrical housing 102*a* and an annular pressurizing sheet support 102*b* fitted into the cylindrical portion of the housing 102*a*. The retainer ring 103 is fixed to the lower end of the housing 102*a* of the top ring body 102. The retainer ring 103 has a lower portion projecting radially inwardly. The retainer ring 103 may be formed integrally with the top ring body 102.

The top ring drive shaft 111 is disposed above the central portion of the housing 102*a* of the top ring body 102, and the top ring body 102 is coupled to the top ring drive shaft 111 by the universal joint 110. The universal joint 110 has a spherical bearing mechanism by which the top ring body 102 and the top ring drive shaft 111 are tiltable with respect to each other, and a rotation transmitting mechanism for transmitting the rotation of the top ring drive shaft 111 to the top ring body 102. The spherical bearing mechanism and the rotation transmitting mechanism transmit a pressing force and a rotating force from the top ring drive shaft 111 to the top ring body 102 while allowing the top ring body 102 and the top ring drive shaft 111 to be tilted with respect to each other.

The spherical bearing mechanism comprises a hemispherical concave recess 111*a* defined centrally in the lower surface of the top ring drive shaft 111, a hemispherical concave recess 102*d* defined centrally in the upper surface of the housing 102*a*, and a bearing ball 112 made of a highly hard material such as ceramics and interposed between the concave recesses 111*a* and 102*d*. On the other hand, the rotation transmitting mechanism comprises drive pins (not shown) fixed to the top ring drive shaft 111, and driven pins (not shown) fixed to the housing 102*a*. Even if the top ring body 102 is tilted with respect to the top ring drive shaft 111, the drive pins and the driven pins remain in engagement with each other while contact points are displaced because the drive pin and the driven pin are vertically movable relative to each other. Thus, the rotation transmitting mechanism reliably transmits rotational torque of the top ring drive shaft 111 to the top ring body 102.

The top ring body 102 and the retainer ring 103 secured to the top ring body 102 have a space defined therein, which accommodates therein an annular holder ring 105, and a disk-shaped chucking plate 106 (vertically movable member) which is vertically movable within the receiving space in the top ring body 102. The chucking plate 106 may be made of metal. However, when the thickness of a thin film formed on a surface of a semiconductor wafer is measured by a method using eddy current in such a state that the semiconductor wafer to be polished is held by the top ring, the chucking plate 106 should preferably be made of a non-magnetic material, e.g., an insulating material such as epoxy glass, fluororesin, or ceramics.

A pressurizing sheet 113 comprising an elastic membrane extends between the holder ring 105 and the top ring body 102. The pressurizing sheet 113 has a radially outer edge clamped between the housing 102*a* and the pressurizing sheet support 102*b* of the top ring body 102, and a radially inner edge clamped between an upper end portion of the chucking plate 106 and the holder ring 105. The top ring body 102, the chucking plate 106, the holder ring 105, and the pressurizing sheet 113 jointly define a pressure chamber 121 in the top ring body 102. As shown in FIG. 4, a fluid passage 9-5 comprising tubes and connectors communicates with the pressure chamber 121, and the pressure chamber 121 is connected to the compressed air source 4 through the pressure controller 3-5 and the regulator R5 provided in the fluid passage 9-5 (see FIG. 3). The pressurizing sheet 113 is made of highly strong and durable rubber material such as ethylene propylene rubber (EPDM), polyurethane rubber, or silicone rubber.

In a case where the pressurizing sheet 113 is made of an elastic material such as rubber, if the pressurizing sheet 113 is fixedly clamped between the retainer ring 103 and the top ring body 102, then a desired horizontal surface cannot be maintained on the lower surface of the retainer ring 103 because of elastic deformation of the pressurizing sheet 113 as an elastic material. In order to prevent such a drawback, the pressurizing sheet 113 is clamped between the housing 102*a* of the top ring body 102 and the pressurizing sheet support 102*b* provided as a separate member in the present embodiment. The retainer ring 103 may vertically be movable with respect to the top ring body 102, or the retainer ring 103 may have a structure capable of pressing the polishing surface independently of the top ring body 102. In such cases, the pressurizing sheet 113 is not necessarily fixed in the aforementioned manner.

An annular edge membrane (elastic membrane) 107 held in contact with the outer circumference edge of the semiconductor wafer W held by the top ring 101 is mounted on the outer circumference edge of the chucking plate 106. The edge membrane 107 has an upper end sandwiched between the outer circumference edge of the chucking plate 106 and the annular edge ring 104. In this manner, the edge membrane 107 is mounted on the chucking plate 106.

As shown in FIG. 4, when the semiconductor wafer W is held by the top ring 101, a pressure chamber 122 is defined in the edge membrane 107. A fluid passage 9-4 comprising tubes and connectors communicates with the pressure chamber 122, and the pressure chamber 122 is connected to the compressed air source 4 through the pressure controller 3-4 and the regulator R4 provided in the fluid passage 9-4 (see FIG. 3). The edge membrane 107 is made of a highly strong and durable rubber material such as ethylene propylene rubber (EPDM), polyurethane rubber, or silicone rubber, as with the pressurizing sheet 113. The rubber material of the edge membrane 107 should preferably have a hardness (duro) ranging from 20 to 70.

When the semiconductor wafer W is polished, the semiconductor wafer W is rotated by rotation of the top ring 101.

The edge membrane 107 alone has a small contact area with the semiconductor wafer W, and is liable to fail to transmit a sufficient rotational torque. Therefore, an annular intermediate air bag 119 for transmitting a sufficient torque to the semiconductor wafer W is fixed to the lower surface of the chucking plate 106 so as to be held in contact with the semiconductor wafer W. The intermediate air bag 119 is disposed radially inwardly of the edge membrane 107, and held in contact with the semiconductor wafer W through a contact area large enough to transmit a sufficient torque to the semiconductor wafer W. The intermediate air bag 19 serves to perform a profile control process.

The intermediate air bag 119 comprises an elastic membrane 191 which is brought into contact with the upper surface of the semiconductor wafer W, and an air bag holder 192 for removably holding the elastic membrane 191. The airbag holder 192 is fixedly mounted by screws (not shown) in an annular groove 106*a* that is defined in the lower surface of the chucking plate 106. The elastic membrane 191 constituting the intermediate air bag 119 is removably mounted on the lower surface of the chucking plate 106 by an upper end of the elastic membrane 191 which is sandwiched between the annular groove 106*a* and the air bag holder 192.

When the semiconductor wafer W is held by the top ring 101, a pressure chamber 124 is defined in the intermediate air bag 119 by the elastic membrane 191 and the air bag holder 192. A fluid passage 9-2 comprising tubes and connectors communicates with the pressure chamber 124, and the pressure chamber 124 is connected to the compressed air source 4 through the pressure controller 3-2 and the regulator R2 provided in the fluid passage 9-2 (see FIG. 3). The elastic membrane 191 is made of a highly strong and durable rubber material, such as ethylene propylene rubber (EPDM), polyurethane rubber, or silicone rubber, as with the pressurizing sheet 113.

An annular space defined by the edge membrane 107, the intermediate air bag 119, the semiconductor wafer W, and the chucking plate 106 serves as a pressure chamber 123. A fluid passage 9-3 comprising tubes and connectors communicates with the pressure chamber 123, and the pressure chamber 123 is connected to the compressed air source 4 through the pressure controller 3-3 and the regulator R3 provided in the fluid passage 9-3 (see FIG. 3).

A circular space defined by the intermediate air bag 119, the semiconductor wafer W, and the chucking plate 106 serves as a pressure chamber 125. A fluid passage 9-1 comprising tubes and connectors communicates with the pressure chamber 125, and the pressure chamber 125 is connected to the compressed air source 4 through the pressure controller 3-1 and the regulator R1 provided in the fluid passage 9-1 (see FIG. 3). The fluid passages 9-1, 9-2, 9-3, 9-4 and 9-5 are connected to the respective pressure controllers 3-1, 3-2, 3-3, 3-4 and 3-5, and the respective regulators R1 through R5 through a rotary joint (not shown) disposed on an upper end of the top ring head 210.

Since there is a small gap G between the outer circumferential surface of the edge membrane 107 and the retainer ring 103, members including the edge ring 104, the chucking plate 106, the edge membrane 107 mounted on the chucking plate 106, and the like are vertically movable with respect to the top ring body 102 and the retainer ring 103, and hence form a floating structure. The chucking plate 106 has a plurality of projections 106*c* projecting outwardly from its outer circumferential edge. When the projections 106*c* engage an upper surface of the inwardly projecting portion of the retainer ring 103, downward movement of the members including the chucking plate 106, etc. is limited to a certain position.

Figure 5A:
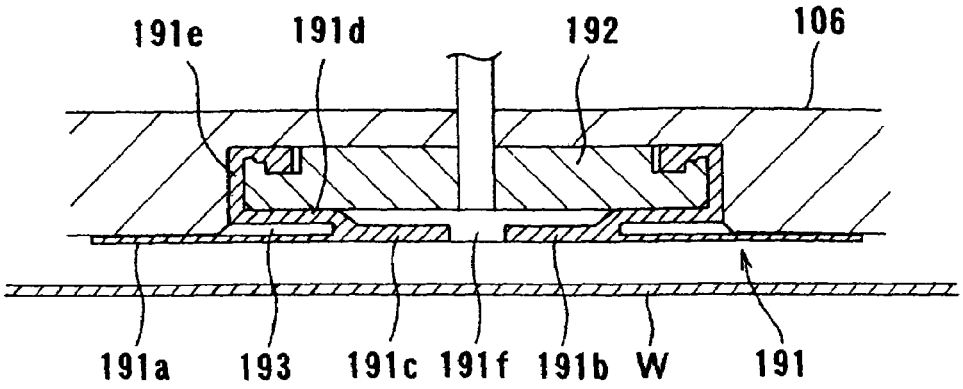
FIGS. 5A through 5C are enlarged cross-sectional views of an intermediate air bag shown in FIG. 4.
Figure 5B:
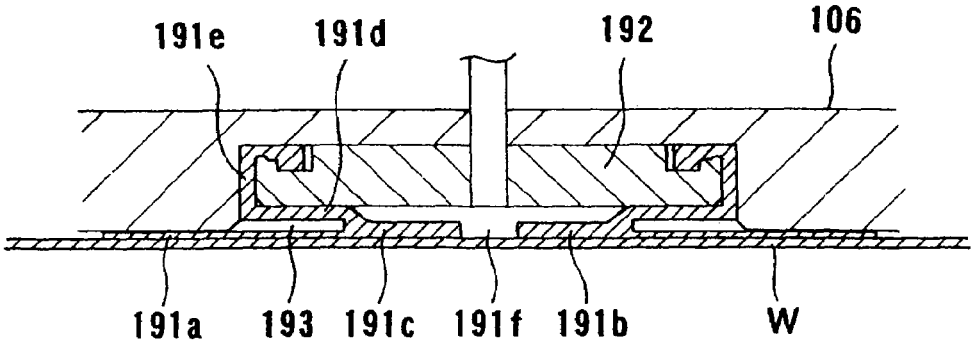
Figure 5C:
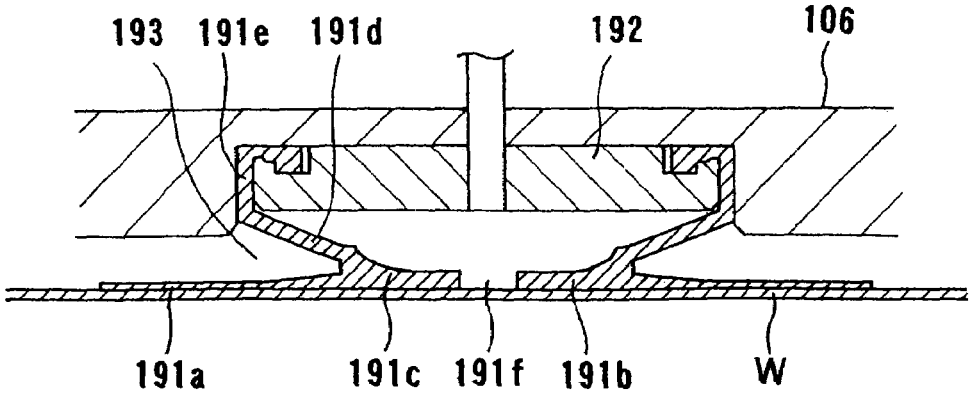

The intermediate air bag 119 will be described in detail below with reference to FIGS. 5A through 5C. FIGS. 5A through 5C are enlarged cross-sectional views showing the intermediate air bag shown in FIG. 4.

As shown in FIG. 5A, the elastic membrane 191 of the intermediate air bag 119 according to the present embodiment has an intermediate contact portion 191*b* having a radially outwardly extending flange 191*a*, an extension 191*d* extending radially outwardly from a base 191*c* of the flanges 191*a* and defining an annular recess 193 between the extension 191*d* and the flange 191*a*, and a joint 191*e* jointed to the chucking plate 106 by the air bag holder 192. The extension 191*d* has an outer end positioned radially inwardly of the flange 191*a*, and the joint 191*e* extends upwardly from the outer end of the extension 191*d*. The flange 191*a*, the intermediate contact portion 191*b*, the joint 191*e*, and the extension 191*d* are integrally formed by an elastic material. The intermediate contact portion 191*b* has an opening 191*f* defined centrally therein.

With the above arrangement, when the semiconductor wafer W is polished in such a state that the chucking plate 106 is lifted upwardly after the semiconductor wafer W is brought into intimate contact with the intermediate contact portion 191*b* of the intermediate air bag 119 (see FIG. 5B), the upward force applied to the joint 191*e* is converted by the extension 191*d* into a horizontal or oblique force which is then applied to the base 191*c* of the flange 191*a* (see FIG. 5C). Therefore, the upward force applied to the base 191*c* of the flange 191*a* is minimized, and hence no excessive upward force is imposed on the intermediate contact portion 191*b*. Accordingly, no vacuum is created in the vicinity of the base 191*c*, and a uniform polishing rate is achieved over the entire surface of the intermediate contact portion 191*b* except the flange 191*a*. The thickness of the joint 191*e* and the length of the flange 191*a* may be of different values in their radially inward and outward regions, and the length of the extension 191*d* may also be of different values in its radially inward and outward regions. Furthermore, the thickness of the flange 191*a* may be changed depending on the type of the film to be polished on the semiconductor wafer W and the type of the polishing pad used. If the resistance and polishing torque transmitted to the semiconductor wafer W are large, then the flange 191*a* should preferably be made thick in order to prevent itself from being twisted.

Figure 6A:
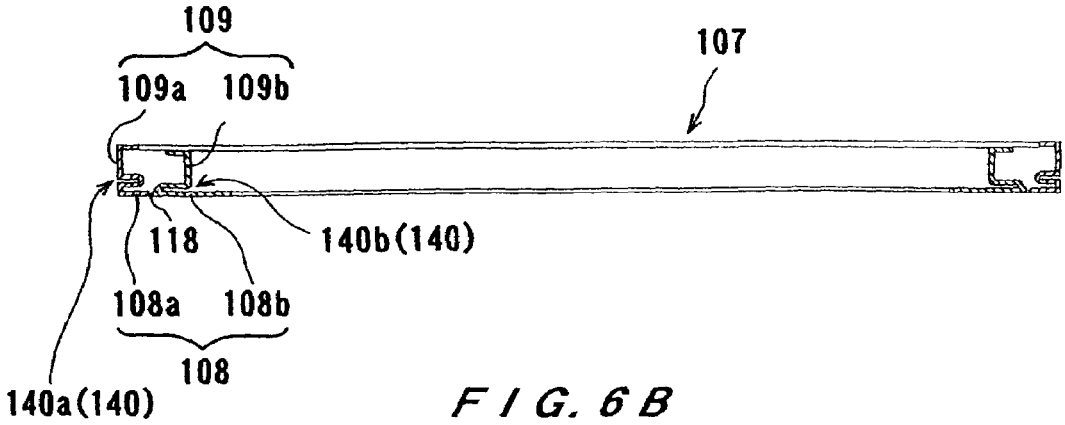
FIG. 6A is a cross-sectional view showing an overall arrangement of an edge membrane according to the embodiment of the present invention.

The edge membrane 107 will be described in detail below with reference to FIGS. 6A through 6C. FIG. 6A is a cross-sectional view showing an entire arrangement of the edge membrane according to the present embodiment, and FIGS. 6B and 6C are fragmentary cross-sectional views of the substrate holding apparatus shown in FIG. 4.

The edge membrane (elastic member) 107 according to the present embodiment has an annular contact portion 108 for contacting the outer circumferential edge of the semiconductor wafer W, and an annular circumferential wall 109 extending upwardly from the contact portion 108 and connected to the chucking plate 106. The circumferential wall 109 comprises an outer circumferential wall 109*a* and an inner circumferential wall 109*b* disposed radially inwardly of the outer circumferential wall 109*a*. The contact portion 108 has a shape extending radially inwardly from the circumferential wall 109 (the outer circumferential wall 109*a* and the inner circumferential wall 109*b*). The contact portion 108 has a circumferentially extending slit 118 defined in a portion thereof which is positioned between the outer circumferential wall 109*a* and the inner circumferential wall 109*b*. The slit 118 divides the contact portion 108 into an outer contact portion 108*a* and an inner contact portion 108*b* between the outer circumferential wall 109*a* and the inner circumferential wall 109*b*.

Figure 6B:
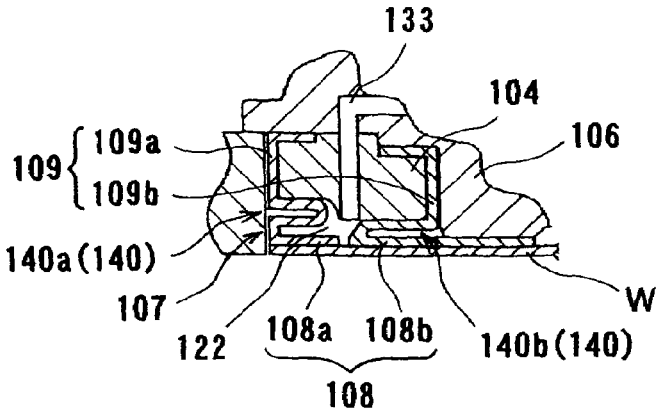
FIGS. 6B and 6C are fragmentary cross-sectional views of the substrate holding apparatus shown in FIG. 4.
Figure 6C:
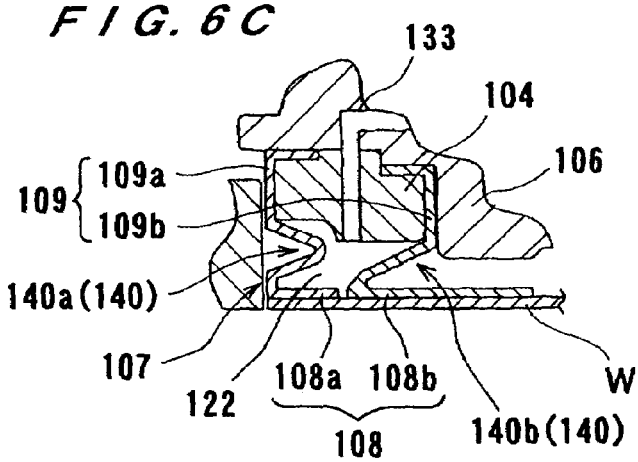

As shown in FIGS. 6B and 6C, the outer circumferential wall 109*a* and the inner circumferential wall 109*b* extend upwardly along the outer and inner circumferential surfaces, respectively, of the annular edge ring 104, and have respective upper ends sandwiched between the chucking plate 106 and the upper surface of the edge ring 104. The edge ring 104 is fastened to the chucking plate 106 by screws (not shown), so that the edge membrane 107 is removably attached to the chucking plate 106. The fluid passage 9-4 extends vertically through the edge ring 104 and is open at the lower surface of the edge ring 104. Therefore, the annular pressure chamber 122 defined by the edge ring 104, the edge membrane 107, and the semiconductor wafer W communicates with the fluid passage 9-4, and is connected to the compressed air source 4 through the fluid passage 9-4, the pressure controller 3-4 and the regulator R4.

The circumferential wall 109 has a stretchable and contractible portion 140 which is stretchable and contractible substantially perpendicularly to the semiconductor wafer W. More specifically, the outer circumferential wall 109*a* of the circumferential wall 109 has a vertically stretchable and contractible portion 140*a*, and the stretchable and contractible portion 140*a* has such a structure that a portion of the outer circumferential wall 109*a* is folded inwardly along the circumferential direction and then folded back outwardly. The stretchable and contractible portion 140*a* is positioned near the outer contact portion 108*a* and located in a position below the edge ring 104. The inner circumferential wall 109*b* of the circumferential wall 109 also has a vertically stretchable and contractible portion 140*b*, and the stretchable and contractible portion 140*b* has such a structure that a portion of the inner circumferential wall 109*b* near its lower end is folded inwardly along the circumferential direction. With the stretchable and contractible portions 140*a*, 140*b* disposed respectively in the outer circumferential wall 109*a* and the inner circumferential wall 109*b*, the outer circumferential wall 109*a* and the inner circumferential wall 109*b* can largely be stretched and contracted while the contact portion 108 (the outer contact portion 108*a* and the inner contact portion 108*b*) is being kept in shape. Therefore, as shown in FIG. 6C, when the chucking plate 106 is elevated, the stretchable and contractible portions 140*a*, 140*b* are stretched so as to follow the movement of the chucking plate 106, thereby keeping a contact area of the edge membrane 107 and the semiconductor wafer W constant.

The pressure chamber 121 defined above the chucking plate 106 and the pressure chambers 122, 123, 124 and 125 defined below the chucking plate 106 are supplied with a pressurized fluid such as pressurized air or the like, or are vented to the atmospheric pressure, or are evacuated to develop a vacuum therein, through the fluid passages 9-1, 9-2, 9-3, 9-4 and 9-5 communicating respectively with those pressure chambers. Specifically, the pressure controllers 3-1, 3-2, 3-3, 3-4 and 3-5 in the fluid passages 9-1 through 9-5 can regulate the pressures of the pressurized fluid that is supplied to the pressure chambers 121 through 125. Therefore, the pressures in the pressure chambers 121 through 125 can be controlled independently of each other, or the pressure chambers 121 through 125 can be vented to the atmospheric pressure or evacuated to develop a vacuum therein.

As shown in FIGS. 3 and 4, the fluid passages 9-1, 9-2, 9-3 and 9-4 connected to the respective pressure chambers 125, 124, 123 and 122 have respective sensors S1, S2, S3 and S4 for detecting flowing states of the fluid supplied through the fluid passages 9-1, 9-2, 9-3 and 9-4 to the pressure chambers 125, 124, 123 and 122.

The relationship between the pressure chambers 125, 124, 123 and 122 and the sensors S1, S2, S3 and S4 will be described below.

The sensors S1, S2, S3 and S4 are arranged to detect the direction of the flow of the fluid therethrough. Specifically, the sensors S1, S2, S3 and S4 are arranged to detect whether the fluid (compressed air) flowing through the fluid passages 9-1, 9-2, 9-3 and 9-4 is flowing from the respective pressure controllers 3-1, 3-2, 3-3 and 3-4 to the pressure chambers 125, 124, 123 and 122 or from the pressure chambers 125, 124, 123 and 122 to the respective pressure controllers 3-1, 3-2, 3-3 and 3-4.

The sensors S1, S2, S3 and S4 are also arranged to detect the flow velocities of the fluid flowing through the fluid passages 9-1, 9-2, 9-3 and 9-4. Because the sensors S1, S2, S3 and S4 can detect the flow velocities of the fluid flowing through the fluid passages 9-1, 9-2, 9-3 and 9-4, the flow rates of the fluid flowing through the fluid passages 9-1, 9-2, 9-3 and 9-4 can be determined by multiplying the flow velocities of the fluid flowing through the fluid passages 9-1, 9-2, 9-3 and 9-4 by the cross-sectional areas of the fluid passages 9-1, 9-2, 9-3 and 9-4, respectively. The calculations may be performed within the sensors S1, S2, S3 and S4 or by a calculating unit of a controller (not shown) which controls the polishing apparatus.

When the pressure chambers 125, 124, 123 and 122 connected to the sensors S1, S2, S3 and S4 thus arranged are supplied with the pressurized fluid (compressed air) under different pressures, if a fluid leakage occurs at the boundary between different pressures, then the pressurized fluid between two adjacent pressure chambers flows from the pressure chamber having a higher pressure into the pressure chamber having a lower pressure. At this time, the pressurized fluid is supplied from the pressure controller at a higher pressure side to the pressure controller at a lower pressure side, and the pressure controller at the lower pressure side discharges the pressurized fluid into the atmosphere.

Figure 7A:
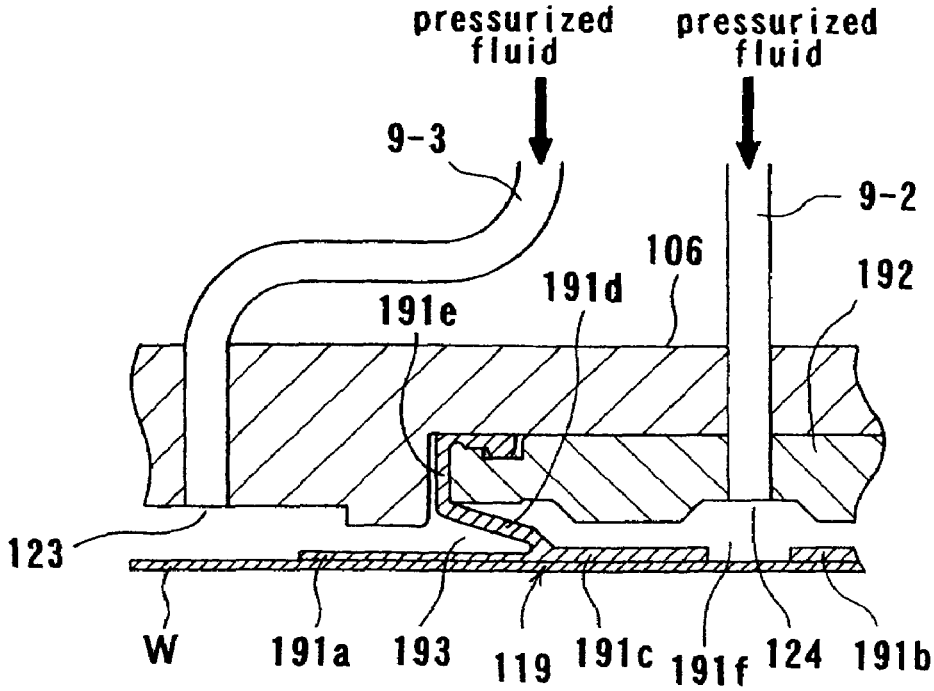
FIG. 7A is a fragmentary cross-sectional view showing the manner in which the substrate holding apparatus having the intermediate air bag is operated normally.
Figure 7B:
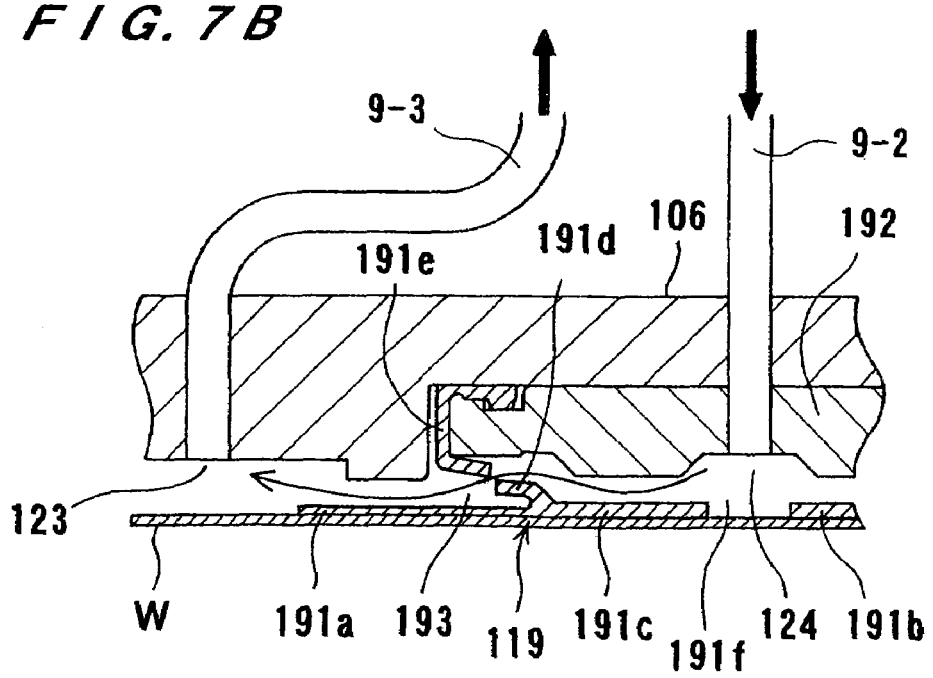
FIG. 7B is a fragmentary cross-sectional view showing the manner in which the substrate holding apparatus having the intermediate air bag which is damaged is operated.

FIG. 7A shows the manner in which the substrate holding apparatus operates with the intermediate air bag 119 being normal, and FIG. 7B shows the manner in which the substrate holding apparatus operates with the intermediate air bag 119 being damaged. As shown in FIG. 7A, if the intermediate air bag 119 is operating normally, when the pressures in the pressure chambers 123, 124 reach preset pressure levels, the flow rates of the fluid flowing through the fluid passages 9-3, 9-2 become zero. However, as shown in FIG. 7B, if the intermediate air bag 119 is being damaged, the pressurized fluid flows from the pressure chamber 124 having a higher pressure into the pressure chamber 123 having a lower pressure. At this time, the pressure controller 3-2 at a higher pressure side supplies the pressurized fluid, and the pressure controller 3-3 at a lower pressure side discharges the pressurized fluid into the atmosphere. Consequently, if a fluid leakage occurs at the boundary between two adjacent pressure chambers that are supplied with the pressurized fluid under different pressures, then the pressurized fluid flows at the same flow rate in a fixed direction from the pressure chamber having the higher pressure into the pressure chamber having the lower pressure.

Usually, since the semiconductor wafer is pressurized or depressurized simultaneously in its entirety, the fluid supplied to the adjacent pressure chambers flows in the same direction at different flow rates. Therefore, if sensors capable of detecting a flow direction of the fluid and a flow rate of the fluid are provided in the respective fluid passages for supplying the pressurized fluid to two adjacent pressure chambers having a higher preset pressure and a lower preset pressure, respectively, then a leakage of the fluid from the pressure chamber having the higher pressure to the pressure chamber having the lower pressure can be detected. Specifically, when the two sensors detect a flow of the fluid from the higher pressure side to the lower pressure side and an identical flow rate of the fluid, it can be judged that a leakage of the fluid occurs. In this case, a leakage of the fluid may be determined when the two sensors detect a flow direction of the fluid or an identical flow rate of the fluid. However, both a flow direction of the fluid and an identical flow rate of the fluid should preferably be monitored for stably detecting a leakage of the fluid.

The above arrangement makes it possible to detect a minute leakage of the fluid. Heretofore, it has been customary to determine the service life of a membrane empirically with a sufficient safety margin. According to the present invention, the service life of a membrane can be judged as having expired when a small crack or a microcrack is developed in the membrane and a minute leakage of the fluid from the small crack or the microcrack is actually detected. It is advantageous to detect such minute leakage, because it takes a certain period of time for the membrane until such small crack or microcrack grows into a large hole or a membrane fracture. The minute leakage referred to above should have a flow rate large enough for a pressure controller to correct the fluid pressure with a feedback circuit.

Even an ordinary flowmeter incapable of detecting the flow direction of a fluid may be used to detect a leakage of the fluid because if higher and lower pressures acting on the semiconductor wafer are determined, then the fluid flows in the same direction at all times when a leakage of the fluid occurs, provided that the flowmeter is installed to detect the fluid flowing in such direction.

As described above, according to the present invention, sensors are installed on both sides of the boundary, where a leakage of a fluid may occur, between regions under different pressures, and a leakage of the fluid can stably be detected by the sensors based on the difference between the flowing state of the fluid at the time the leakage occurs and the flowing state of the fluid at the time no leakage occurs and the pressures are normally acting on the regions.

Overall operation of the polishing apparatus which is provided with the top ring 101 having the pressure control system CS shown in FIGS. 3 and 4 will be described below.

When the semiconductor wafer W is to be supplied to the top ring 101, the top ring 101 is placed in its entirety into a position for transferring the semiconductor wafer W. The pressure chamber 123 and/or the pressure chamber 124 and/or the pressure chamber 125 is connected to a vacuum source through the fluid passage 9-3 and/or the fluid passage 9-2 and/or the fluid passage 9-1, and is evacuated to develop a vacuum therein. Further, the pressure chamber 121 is connected to the vacuum source through the fluid passage 9-5, and is evacuated to develop a vacuum therein. The pressure chamber 123 and/or the pressure chamber 124 and/or the pressure chamber 125 now attracts the semiconductor wafer W under vacuum to the lower surface of the top ring 101. Further, the chucking plate 106 is lifted together with the semiconductor wafer W by attraction action of the pressure chamber 121 until the chucking plate 106 is brought into contact with the inner bottom surface 102*e* of the top ring body 102. Then, the top ring 101 holding the semiconductor wafer W under vacuum is moved in its entirety to a position above the polishing table 200 having the polishing surface (the polishing pad 201). The outer circumferential edge of the semiconductor wafer W is retained by the retainer ring 103, and the semiconductor wafer W is housed in a recessed opening 100 which is defined by the top ring body 102 and the retainer ring 103 and is open downwardly, whereby the semiconductor wafer W is protected.

Then, the pressure chamber 123 and/or the pressure chamber 124 and/or the pressure chamber 125 release the semiconductor wafer W. At the same time, attraction of the pressure chamber 121 is released and the top ring air cylinder 211 connected to the top ring drive shaft 111 is operated to lower the top ring 101 and bring the top ring 101 into contact with the polishing pad 201 attached to the polishing table 200 under a predetermined pressure. After this contact, the retainer ring 103 fixed to the lower end of the top ring 101 is pressed against the polishing surface of the polishing table 200 under a predetermined pressure. At the same time, the pressure chamber 121 is supplied with the pressurized fluid to lower the chucking plate 106, thereby pressing the edge membrane 107 and the intermediate air bag 119 against the semiconductor wafer W. The lower surfaces of the edge membrane 107 and the intermediate air bag 119 are now reliably held in intimate contact with the upper surface of the semiconductor wafer W. In this state, the pressure chambers 122 through 125 are supplied with the pressurized fluid under respective pressures, thereby lifting the chucking plate 106 and pressing the semiconductor wafer W against the polishing surface of the polishing table 200.

At this time, the pressures of the fluid supplied to the respective pressure chambers 121, 122, 123, 124 and 125 are set and stored in the host computer 11 shown in FIG. 1, and the respective set pressures are sent from the host computer 11 to the arithmetic unit 1. As a result, the respective set pressures are sent from the arithmetic unit 1 to the respective pressure controllers 3-1, 3-2, 3-3, 3-4 and 3-5. At an initial point of time when the recipe is sent to the respective pressure controllers 3-1, 3-2, 3-3, 3-4 and 3-5, the set pressures are applied to the respective pressure chambers 125, 124, 123, 122 and 121 with precision of the respective pressure controllers 3-1, 3-2, 3-3, 3-4 and 3-5. Thereafter, the pressures of the respective pressure controllers 3-1, 3-2, 3-3, 3-4 and 3-5 are calibrated by the master pressure controller 2 according to the process which has been described with reference to FIG. 1. As described in the embodiment shown in FIG. 1, it is desirable from a viewpoint of the response that the calibration is performed from the pressure controller whose set pressure is smaller. Then, after this calibration, the respective pressure controllers 3-1, 3-2, 3-3, 3-4 and 3-5 supply a pressurized fluid whose pressure is accurately adjusted to the set pressure to the respective pressure chambers 125, 124, 123, 122 and 121. Thus, the pressure applied to the semiconductor wafer W can be accurately controlled for every zone (region).

At this time, the stretchable and contractible portions 140*a*, 140*b* provided in the edge membrane 107 are stretched so as to follow the upward movement of the chucking plate 106. Therefore, the contact area between the lower surface, i.e. the contact portion 108, of the edge membrane 107 and the outer circumferential edge of the semiconductor wafer W can be kept constant. The polishing liquid supply nozzle 202 supplies a polishing liquid Q onto the polishing surface of the polishing pad 201 in advance, so that the polishing liquid Q is held on the polishing pad 201. Thus, the semiconductor wafer W is polished in the presence of the polishing liquid Q between the (lower) surface, to be polished, of the semiconductor wafer W and the polishing pad 201.

With the top ring (substrate holding apparatus) 101 according to the present embodiment, since the area in which the edge membrane 107 and the outer circumferential edge of the semiconductor wafer W contact each other is kept constant, the pressing force imposed on the outer circumferential edge of the semiconductor wafer W is prevented from changing. Therefore, the entire surface of the semiconductor wafer W including its outer circumferential edge can be pressed against the polishing surface under a uniform pressing force. As a result, the polishing rate on the outer circumferential edge of the semiconductor wafer W is prevented from being lowered, and the polishing rate in a region that is positioned radially inwardly of the outer circumferential edge of the semiconductor wafer W is prevented from being locally increased. Specifically, if the semiconductor wafer has a diameter of 200 mm, then the polishing rate in a region that is positioned about 20 mm from the outer periphery of the semiconductor wafer W is prevented from being increased, and if the semiconductor wafer has a diameter of 300 mm, then the polishing rate in a region that is positioned about 25 mm from the outer periphery of the semiconductor wafer W is prevented from being increased.

The circumferentially extending slit 118 formed in the contact portion 108 of the edge membrane 107 is effective to increase the stretchability of the circumferential wall 109 (the outer circumferential wall 109*a* and the inner circumferential wall 109*b*) in the downward direction. Therefore, even when the pressure of the fluid supplied to the pressure chamber 122 is reduced, the range of contact between the edge membrane 107 and the semiconductor wafer W is kept proper, thus allowing the semiconductor wafer W to be pressed under a smaller pressing force.

The regions of the semiconductor wafer W which are positioned respectively underneath the pressure chambers 122, 123, 124 and 125 are pressed against the polishing surface under the pressures of the pressurized fluid supplied to the respective pressure chambers 122, 123, 124 and 125. Therefore, by controlling the pressures of the pressurized fluid supplied to the respective pressure chambers 122, 123, 124 and 125 by the pressure controllers 3-4, 3-3, 3-2 and 3-1, the entire surface of the semiconductor wafer W can be pressed against the polishing surface under a uniform force, achieving a uniform polishing rate over the entire surface of the semiconductor wafer W. Similarly, the pressure of the pressurized fluid supplied to the pressure chamber 121 can be regulated by the pressure controller 3-5 to change the pressing force for pressing the retainer ring 103 against the pressing pad 201. In this manner, the polishing profile of the semiconductor wafer W can be controlled by appropriately regulating the pressing force for pressing the retainer ring 103 against the polishing pad 201 and the pressing force for pressing the semiconductor wafer W against the polishing pad 201 with the pressure chambers 122, 123, 124 and 125. The semiconductor wafer W has a region to which the pressing force is applied from the fluid through the contact portion of the intermediate air bag 119, and a region to which the pressure of the pressurized fluid is directly applied. The pressing forces applied to these regions of the semiconductor wafer W are identical to each other.

As described above, the pressing force for pressing the retainer ring 103 against the polishing pad 201 and the pressing forces for pressing the semiconductor wafer W against the polishing pad 201 are accurately controlled with the pressurized fluid controlled accurately and supplied to the respective pressure chambers 121, 122, 123, 124 and 125, thereby polishing the semiconductor wafer W.

While the semiconductor wafer W is being polished as described above, when the pressurized fluid is supplied to the pressure chambers 122, 123, 124 and 125 under respective different pressures to press the semiconductor wafer W in locally different pressing states, if the two sensors for two adjacent pressure chambers of the sensors S1 through S4 in the respective fluid passages 9-1 through 9-4 for supplying the fluid to the pressure chambers 122 through 125 detect a certain fluid flow direction, then it is judged that the boundary (membrane) between those two adjacent pressure chambers is damaged or broken. At this time, the top ring 101 attracts the semiconductor wafer W under vacuum and is lifted from the polishing surface, thereby stopping polishing of the semiconductor wafer W. If the two sensors for two adjacent pressure chambers detect a fluid flow at the same flow rate, then it is also judged that the boundary (membrane) between those two adjacent pressure chambers is damaged or broken. At this time, the polishing of the semiconductor wafer W is also stopped.

When the polishing process is finished, the supply of the pressurized fluid to the pressure chamber 122 is stopped, and the pressure chamber 122 is vented to the atmosphere. At the same time, a negative pressure is developed in the pressure chamber 123 and/or the pressure chamber 124 and/or the pressure chamber 124 to attract the semiconductor wafer W again to the lower end surface of the top ring 101 under vacuum. At this time, the pressure of the pressure chamber 121 is made an atmospheric pressure or a negative pressure. This is because if the pressure in the pressure chamber 121 remains high, the semiconductor wafer W would be locally pressed against the polishing surface by the lower surface of the chucking plate 106.

After the semiconductor wafer W is thus held under vacuum, the top ring 101 in its entirety is positioned in the transfer position for the semiconductor wafer W, and the vacuum attraction of the semiconductor wafer W by the pressure chamber 123 and/or the pressure chamber 124 and/or the pressure chamber 125 is released. Then, a fluid (e.g., a pressurized fluid or a mixture of nitrogen and pure water) is ejected from the fluid passage 9-3 to the semiconductor wafer W, thereby removing the semiconductor wafer W from the top ring 101.

While an embodiment of the present invention has been described above, the present invention is not limited to the above embodiment, but may be embodied in various different forms within the scope of the technical idea thereof.

Although certain preferred embodiments of the present invention have been shown and described in detail, it should be understood that various changes and modifications may be made therein without departing from the scope of the appended claims.

What is claimed is:

1. A pressure control method comprising:

supplying a first pressurized fluid from a master pressure controller to a first calibration chamber;

supplying a second pressurized fluid from a first pressure controller to said first calibration chamber;

detecting a differential pressure between the first pressurized fluid and the second pressurized fluid; and adjusting a pressure of said second pressurized fluid so that the differential pressure between the first pressurized fluid and the second pressurized fluid becomes zero or approximately zero.

2. A pressure control method according to claim 1, further comprising:

supplying a third pressurized fluid from said master pressure controller to a second calibration chamber;

supplying a fourth pressurized fluid from a second pressure controller to said second calibration chamber;

detecting a differential pressure between the third pressurized fluid and the fourth pressurized fluid; and adjusting a pressure of the fourth pressurized fluid so that the differential pressure between the third pressurized fluid and the fourth pressurized fluid becomes zero or approximately zero.

3. A pressure control method according to claim 2, wherein the pressure of the second pressurized fluid is lower than the pressure of the fourth pressurized fluid.

4. A pressure control method according to claim 3, wherein the second pressurized fluid is used for pressing a first zone of a substrate and the fourth pressurized fluid is used for pressing a second zone of the substrate.

5. A pressure control method comprising:

supplying a first pressurized fluid from a master pressure controller to a first calibration chamber;

supplying a second pressurized fluid from said master pressure controller to a second calibration chamber;

supplying a third pressurized fluid from a first pressure controller to said first calibration chamber;

detecting a differential pressure between the first pressurized fluid and the third pressurized fluid;

adjusting a pressure of said third pressurized fluid so that the differential pressure between the first pressurized fluid and the third pressurized fluid becomes zero or approximately zero;

supplying a fourth pressurized fluid from a second pressure controller to said second calibration chamber;

detecting a differential pressure between the second pressurized fluid and the fourth pressurized fluid; and adjusting a pressure of the fourth pressurized fluid so that the differential pressure between the second pressurized fluid and the fourth pressurized fluid becomes zero or approximately zero.

6. A pressure control method according to claim 5, wherein the pressure of said third pressurized fluid is lower than the pressure of said fourth pressurized fluid.

7. A pressure control method according to claim 6, wherein the third pressurized fluid is used for pressing a first zone of a substrate and the fourth pressurized fluid is used for pressing a second zone of the substrate.

8. A pressure control system comprising:

a first pressure controller configured to supply a first pressurized fluid to a first pressure-controlled section;

a master pressure controller configured to supply a second pressurized fluid;

a first calibration chamber corresponding to said first pressure controller, the first pressurized fluid and the second pressurized fluid being supplied to said first calibration chamber, said first calibration chamber being configured to detect a differential pressure between the first pressurized fluid and the second pressurized fluid; and an arithmetic device configured to receive a signal from said first calibration chamber and adjust an output of said first pressure controller so that the differential pressure between the first pressurized fluid and the second pressurized fluid becomes zero or approximately zero.

9. A pressure control system according to claim 8, further comprising:

a second pressure controller configured to supply a third pressurized fluid to a second pressure-controlled section; and a second calibration chamber corresponding to said second pressure controller;

wherein said master pressure controller supplies a fourth pressurized fluid;

the third pressurized fluid and the fourth pressurized fluid are supplied to said second calibration chamber;

said second calibration chamber detects a differential pressure between the third pressurized fluid and the fourth pressurized fluid; and said arithmetic device adjusts an output of said second pressure controller so that the differential pressure between the third pressurized fluid and the fourth pressurized fluid becomes zero or approximately zero.

10. A pressure control system according to claim 9, wherein each of said first and second calibration chambers has a differential-pressure detecting device, said differential-pressure detecting device being configured to detect a differential pressure between the pressurized fluid supplied from said first or second pressure controller and the pressurized fluid supplied from said master pressure controller.

11. A pressure control system according to claim 10, wherein said differential-pressure detecting device comprises a diaphragm provided in said calibration chamber and configured to separate the pressurized fluid supplied from said first or second pressure controller and the pressurized fluid supplied from said master pressure controller each other, and a sensor configured to detect displacement of said diaphragm.

12. A pressure control system according to claim 9, further comprising a closing valve provided between said master pressure controller and each of said calibration chambers and configured to seal the pressurized fluid supplied from said master pressure controller in said calibration chamber hermetically by closing said closing valve.

13. A pressure control system according to claim 12, further comprising a leakage sensor configured to detect a leakage of the pressurized fluid from said calibration chamber while said closing valve is closed.

14. A polishing apparatus comprising:

a polishing table having a polishing surface: and a substrate holding apparatus for holding a substrate and pressing the substrate against said polishing surface, comprising:

a pressure control system comprising:

a first pressure controller configured to supply a first pressurized fluid to a first pressure-controlled section;

a master pressure controller configured to supply a second pressurized fluid;

a first calibration chamber corresponding to said first pressure controller, the first pressurized fluid and the second pressurized fluid being supplied to said first calibration chamber, said first calibration chamber being configured to detect a differential pressure between the first pressurized fluid and the second pressurized fluid; and an arithmetic device configured to receive a signal from said first calibration chamber and adjust an output of said first pressure controller so that the differential pressure between the first pressurized fluid and the second pressurized fluid becomes zero or approximately zero;

a top ring body for holding the substrate;

a plurality of pressure chambers formed in said top ring body; and a plurality of fluid passages configured to connect said pressure chambers to said pressure controllers, respectively.

15. A polishing apparatus according to claim 14, further comprising:

a second pressure controller configured to supply a third pressurized fluid to a second pressure-controlled section; and a second calibration chamber corresponding to said second pressure controller;

wherein said master pressure controller supplies a fourth pressurized fluid;

the third pressurized fluid and the fourth pressurized fluid are supplied to said second calibration chamber;

said second calibration chamber detects a differential pressure between the third pressurized fluid and the fourth pressurized fluid; and said arithmetic device adjusts an output of said second pressure controller so that the differential pressure between the third pressurized fluid and the fourth pressurized fluid becomes zero or approximately zero.

* * * * *